US005135022A

United States Patent [19]

Kovey et al.

[11] Patent Number: 5,135,022

[45] Date of Patent: Aug. 4, 1992

[54] VERTICALLY ADJUSTABLE VALVE FITTING ASSEMBLY FOR TUBS

[75] Inventors: Stephan Kovey, Glen Ellyn, Ill.; Charles W. McTargett, Indianapolis, Ind.

[73] Assignee: Masco Corporation of Indiana, Taylor, Mich.

[21] Appl. No.: 642,494

[22] Filed: Jan. 17, 1991

[51] Int. Cl.[5] ..... F16L 5/00

[52] U.S. Cl. ..... 137/360; 137/801; 4/675

[58] Field of Search ..... 137/360, 359, 801, 315; 4/191

[56] References Cited

U.S. PATENT DOCUMENTS

| | | | |
|---|---|---|---|
| 1,602,544 | 10/1926 | Muend | 137/360 |
| 1,619,748 | 3/1927 | Muend | 137/360 |
| 1,654,550 | 1/1928 | Muend | 137/360 |
| 2,233,267 | 2/1941 | McGarry | 137/111 |
| 2,896,222 | 7/1959 | Freibott | 4/191 |
| 2,997,058 | 8/1961 | Hall | 137/360 |
| 3,136,570 | 6/1964 | Lee | 285/193 |
| 3,438,065 | 4/1969 | Morris | 4/191 |
| 3,856,334 | 12/1974 | Lange | 137/360 |
| 3,971,401 | 7/1976 | Persson | 137/360 |
| 4,083,410 | 4/1978 | Anderson | 285/302 |
| 4,463,460 | 8/1984 | Arnold et al. | 4/191 |
| 4,662,389 | 5/1987 | Igbal | 137/360 |

*Primary Examiner*—A. Michael Chambers

*Attorney, Agent, or Firm*—Myron B. Kapustij; Malcolm L. Sutherland

[57] ABSTRACT

A vertically adjustable fixture assembly for mounting a valve and handle assembly to the exposed side of a wall or deck of a tub such as a Roman tub. The assembly comprises a hollow externally threaded receiver body adapted to receive a water inlet pipe and a water outlet pipe located on the hidden side of the wall or deck, and having valving means including valve stem means disposed in the portion thereof extending above the exposed side of the wall or deck. An internally threaded adapter is threadably received over the receiver body. The adapter is mounted within an opening in the wall or deck within one end of a flange, the other end of the flange being secured to the wall or deck. The adapter is free to rotate within the flange but is secured against axial or vertical movement relative to the deck or wall by the flange. Rotation of the adapter provides adjustment of the axial position of the receiver body relative to the wall or deck during mounting. Once the desired axial position of the receiver body is achieved the adapter is secured against further rotational movement by engagement with retainer means secured to the adapter by an internally threaded jam nut threadably received over the receiver body.

13 Claims, 3 Drawing Sheets

VERTICALLY ADJUSTABLE VALVE FITTING ASSEMBLY FOR TUBS

FIELD OF THE INVENTION

The invention relates to the field of plumbing fixtures, and more specifically to a vertically adjustable valve fitting for tub fixtures.

BACKGROUND OF THE INVENTION

Present designs for some tubs, particularly Roman tubs, typically incorporate valve fittings which are mounted, together with a large spout, on the deck or alongside the tube or on an adjacent wall. The valve fittings typically have a threaded shank which serves to receive the water inlet and water outlet pipes and also may serve as the mounting means. There are some disadvantages to this conventional design approach. One disadvantage is that connections between the valve fitting and the water supply pipe cannot be made until after the surface finishing material is applied to the rough surface of the deck or wall, since for aesthetic reasons the handle assembly mounted on top of the valve fitting rests upon the finished surface. This is a disadvantage because surface finishing is not accomplished until after the deck or wall is closed up, which means installing an access panel in the deck or wall and having to make the pipe connections in a confined area through the typically small access panel. Another disadvantage is that a return trip by the plumber is necessitated after the rough plumbing is done in order to make the solder connections between the valve fitting and related water supply lines after finishing work on the wall or deck is completed.

Further, such valve fittings have fixed length shafts which do not permit wide variance in the roughing in dimensions for the placement of the water supply pipe.

The present invention provides a valve fitting fixture assembly for tubs, particularly Roman tub spouts, which is vertically adjustable relative to the rough wall. This permits the connections between the valve fitting and the related water supply pipes to be made at the same time the roughing in plumbing is done. It also permits the valve fitting to be easily installed after all the finishing work has been accomplished without the need for a return trip by the plumber in order to install the valve fittings.

SUMMARY OF THE INVENTION

One embodiment of the present invention includes an externally threaded hollow tubular receiver body having a bottom portion and a top portion. A valve assembly is disposed in said top portion and is in communication with water inlet and water outlet pipes received in said bottom portion and extending axially through the hollow interior of said receiver body. An externally threaded hollow tubular adapter is threadably received over the receiver body in order to vertically or axially adjustably mount the receiver body within an opening in walls or decks of different thicknesses. The adapter has two axially spaced apart radially extending flanges defining a slot therebetween on one end thereof. The two radially extending flanges define the top and bottom sides of the slot while the tubular wall of the adapter defines the inner side of the slot. The slot is engaged by one side of a flat flange having a cut-out portion having a cross-sectional configuration complementary to the cross-sectional configuration of the slot.

The other end of the flat flange is secured to the deck or wall. The adapter is thus secured against axial or vertical movement by engagement with said flat flange. However, the adapter is free to rotate within said flat flange. Rotation of the adapter results in telescopic vertical or axial movement of the receiver body within the adapter. Once the receiver body is adjusted to the desired axial or vertical position the adapter is secured against further rotational movement by means of a retainer comprising an annular member having at least three downwardly depending legs, two of the legs engaging the sides of at least one of the axially extending flanges and the other leg engaging a recess in the flat flange secured to the rough wall or deck. An internally threaded jam nut is screwed down against the retainer to secure the retainer against the radially extending flange on the adapter.

DESCRIPTION OF THE PREFERRED EMBODIMENTS

Figure 2:
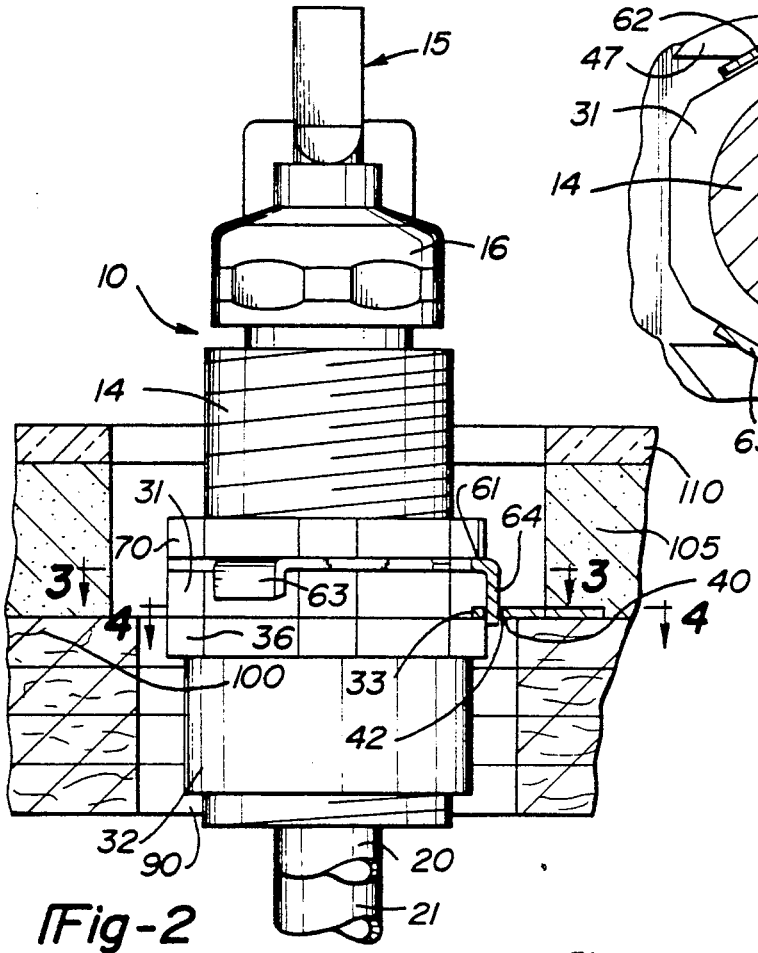
FIG. 2 is a side elevational view, partly in section, of the assembly of FIG. 1 completely assembled and mounted within a deck of a conventional type tub.

Referring now to the drawings, FIG. 2 shows the adjustable valve fitting assembly 10 completely connected and mounted within the deck of a tub such as a Roman tub. Alternatively, assembly 10 could be mounted within an adjacent vertical wall given a varient valve fitting design which relates to such an orientation. Assembly 10 includes receiver body 11 which has a generally cylindrical shape. Receiver body 11 has a top portion 12 and a bottom portion 13. Receiver body 11 has external threads 14 along its length in order to threadably receive adapter 30 in a manner which will be more fully described herein. Receiver body 11 also has an internal passageway (not shown) extending longitudinally therethrough from the bottom portion 13 to the top portion 12.

Water inlet pipe 20 connected to a water supply enters the passageway through an opening in the bottom portion 13 of receiver body 11 and extends through the passageway until it communicates with valve inlet opening (not shown) and valve and stem assembly 15 disposed in the top portion 12 of receiver body 11. Water outlet pipe 21, which is in communication with the valving system in the top portion 12 of receiver body, extends through the passageway and exits through an opening in the bottom portion 13 of receiver body 11. Water outlet pipe 21 is in communication with a tub spout. Valve and stem assembly 15 is secured in the internal passageway of receiver body 11 in the top portion 12 thereof by lock nut 16 threadably engaged with a reduced diameter top section of receiver body. The valve and stem assembly 15 and valve inlet openings are conventional and well known in the art and, therefore, will not be further described herein. A handle 80 is mounted onto the top of valve stem assembly 15.

FIG. 2 shows adapter 30 threadably received over receiver body 11. Adapter 30 is comprised of tubular wall 32. Two radially extending axially spaced apart external flanges 31 and 36 are disposed adjacent one end of tubular wall 32. Flanges 31 and 36 have a polygonal, preferably hexogonal, cross-sectional configuration. The two flanges 31 and 36 along with tubular wall 32 define a slot 33 therebetween. A passageway 35 extends longitudinally through tubular wall 32 of adapter 30. Adapter 30 has internal threads 34 along the entire length of passageway 35. The inner diameter of passageway 35 is larger than outer diameter of receiver body 11, so that receiver body 11 is threadably received within passageway 35 of adapter 30.

Assembly 10 includes a flat mounting flange 40. Flange 40 includes a semi-circular front portion 46 and two spaced apart arm portions 47 and 48 extending forwardly of said semi-circular portion 46 which together form a shaped inner section 48 defining cut-out 45. The radius of semi-circular inner portion 46 is substantially the same as the outer radius of the tubular section 32 of adapter 30. The two arm portions 47 and 48 are spaced apart a distance which is about twice the outer radius of the tubular sections 32 of adapter 30. The shaped inner section 48 of flange 42 fits into the slot 33 and abuts against tubular wall 32 of adapter 30.

The flange 40 also has two generally circular screw openings 44 and 43 in arms 47 and 48, respectively, adapted to receive screws 51 and 50. Flange 40 also has a generally rectangular shaped aperture 42 extending through the semi-circular front portion 46.

In one method of installing the valve fitting assembly 10 of the instant invention, receiver body 11 is fitted inside a hole 90 in rough wall layer 100 so that the valve and stem assembly 15 extends above the surface of rough wall layer 100 upon which finished wall layer 105 and, if desired, tiles 110, are to be applied. The shaped inner section 48 of flange 40 is inserted into slot 33 of adapter 30, and adapter 30 is then screwed onto the receiver body 11 and down the receiver body 11 until the flange 40 contacts the upper or exposed side of rough wall layer 100. Screws 51 and 50 are then used to firmly secure flange 40 to the exposed side of rough wall 100. The adapter 30 may then be rotated until the receiver body 11 is adjusted to a desired axial position relative to the rough wall 100. In another method of installation the adapter 30 is first fitted over receiver body 11 and thereafter flange 40 is inserted into slot 33 of adapter 30.

Figure 3:
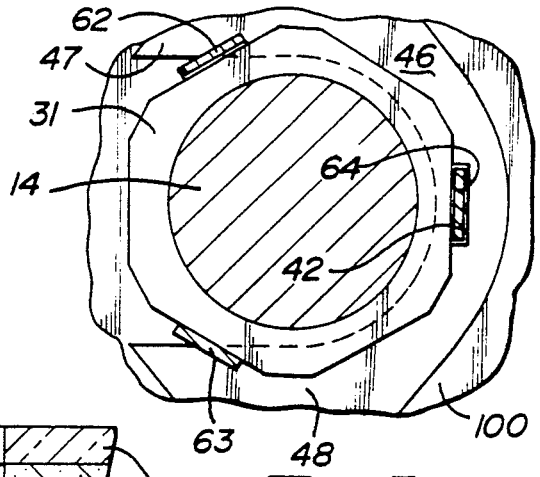
FIG. 3 is a cross-sectional view taken along line 3—3 of FIG. 2.
Figure 4:
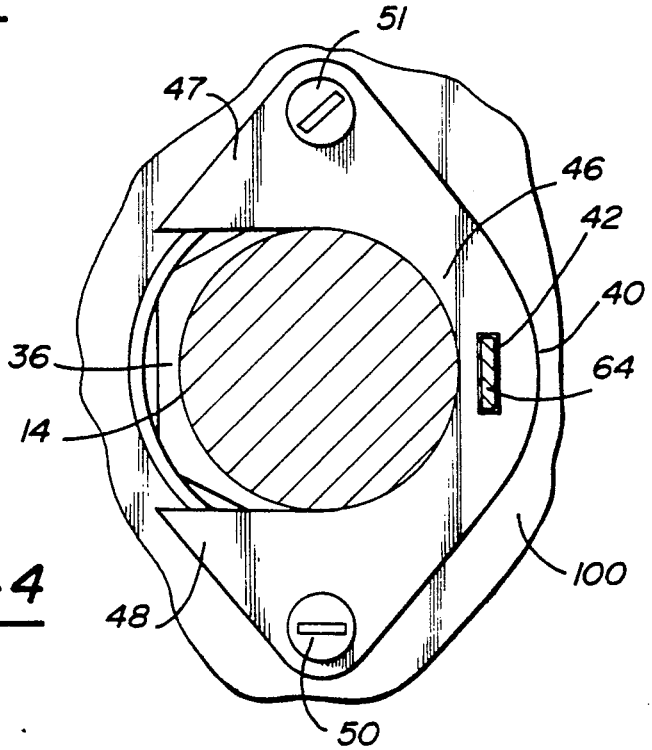
FIG. 4 is a cross-sectional view taken along line 4—4 of FIG. 2.

A retainer 60 comprised of annular member 61, two downwardly projecting short legs 62 and 63, and a downwardly projecting long leg 64 is then slid downwardly over receiver body 11 until it abuts against flange 31 of adapter 30. The retainer is aligned, as best seen in FIG. 3, so that the long leg 64 of retainer 60 is inserted into slot 42 in flange 40, and the two short legs 62 and 63 abut against the surfaces of two side faces or sides of polygonal flange 31.

An internally threaded jam nut 70 is then screwed down over receiver body 11 until it contacts the top of annular member 61 of retainer 60. Jam nut 70 is then tightened over retainer 60 in order to secure retainer 60 against flange 31 to thereby prevent rotation of adapter 30.

To adjust the height of the valve and stem assembly 15 relative to finished wall 105 jam nut 70 is loosened from retainer 60 and preferably removed from receiver body 11, retainer 60 is slid upwardly over receiver body 11 until legs 62 and 63 are out of engagement with flange 31 and is preferably removed from receiver body 11, and adapter 30 is rotated clockwise or counterclockwise to either lower or raise the receiver body relative to the finished wall 105. Since adapter 30 is fixed against axial movement by engagement with flange 40 which is secured to rough wall 100, rotation of adapter 30 about receiver body 11 results in telescopic axial movement of receiver body 11 in adapter 30.

With the adapter 30 engaged with flange 40, and with flange 40 secured to rough wall 100, adapter 30 is secured against axial or vertical movement relative to rough wall 100. Adapter 30 is, however, at this point not secured against rotational movement and can be freely rotated. Rotation of adapter 30 causes telescopic axial movement of receiver body 11 relative to axially fixed adapter 30. Axial or vertical movement of receiver body 11 is possible because the water inlet and outlet pipes 20, 21 have sufficient slop so that the receiver body 11 can be raised or lowered a certain distance, usually at least about 1 to 2 inches.

With the retainer 60 abuting flange 31, wherein legs 63 and 62 fit over and engage the sides of flange 31 and leg 64 is inserted into slot 42 of flange 40, the adapter is fixed against rotational movement.

Figure 1:
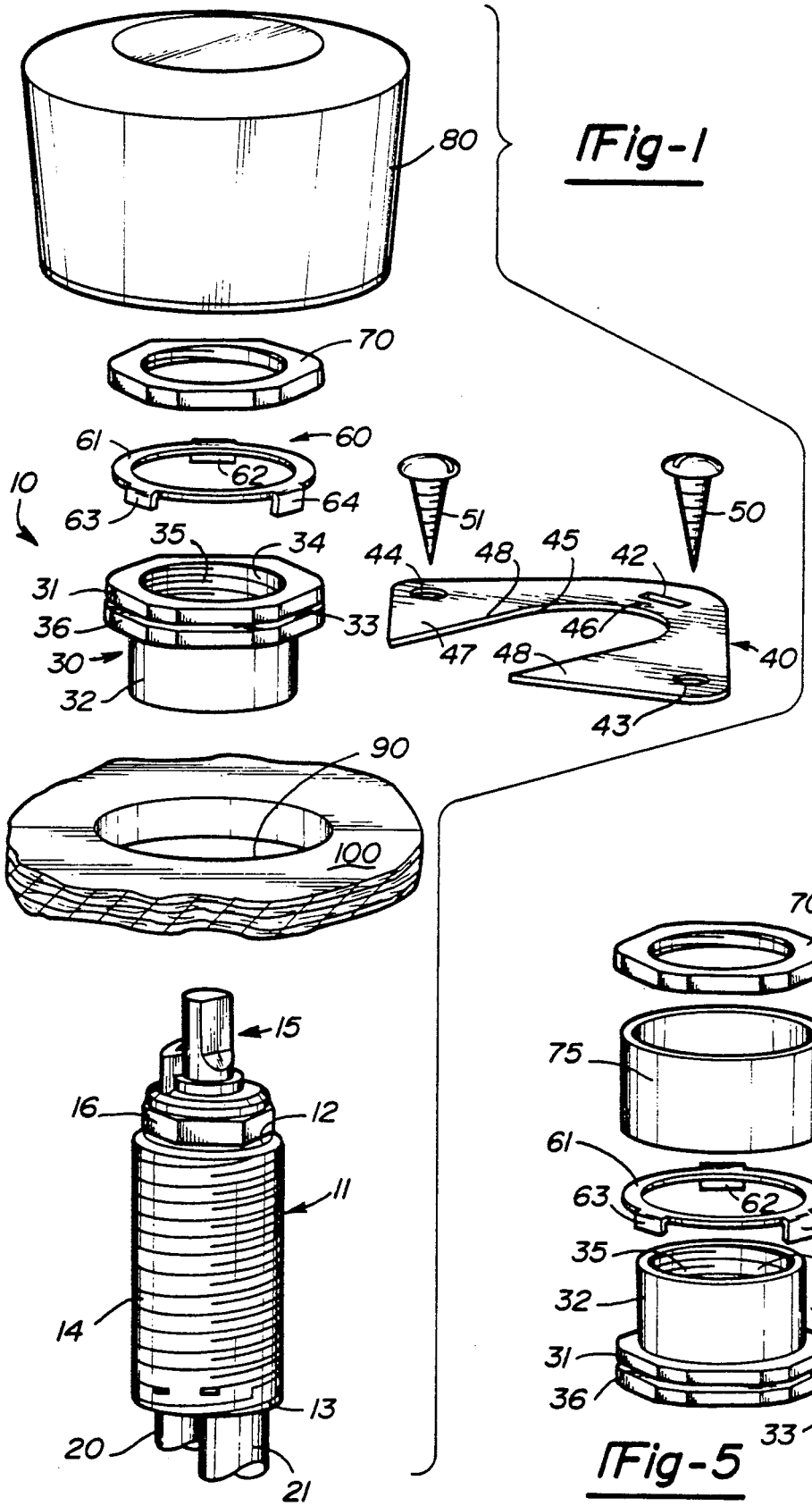
FIG. 1 is an exploded perspective view of the components of the assembly of the instant invention.
Figure 5:
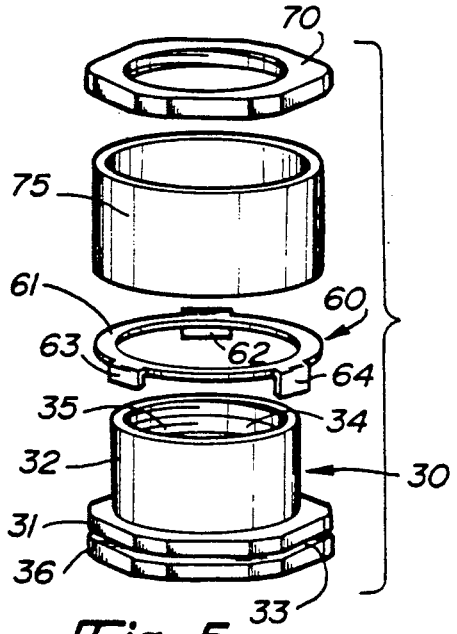
FIG. 5 is an exploded perspective view of another embodiment of the instant invention wherein the adapter is mounted over the receiver body in an inverse position relative to that illustrated in FIG. 1.
Figure 6:
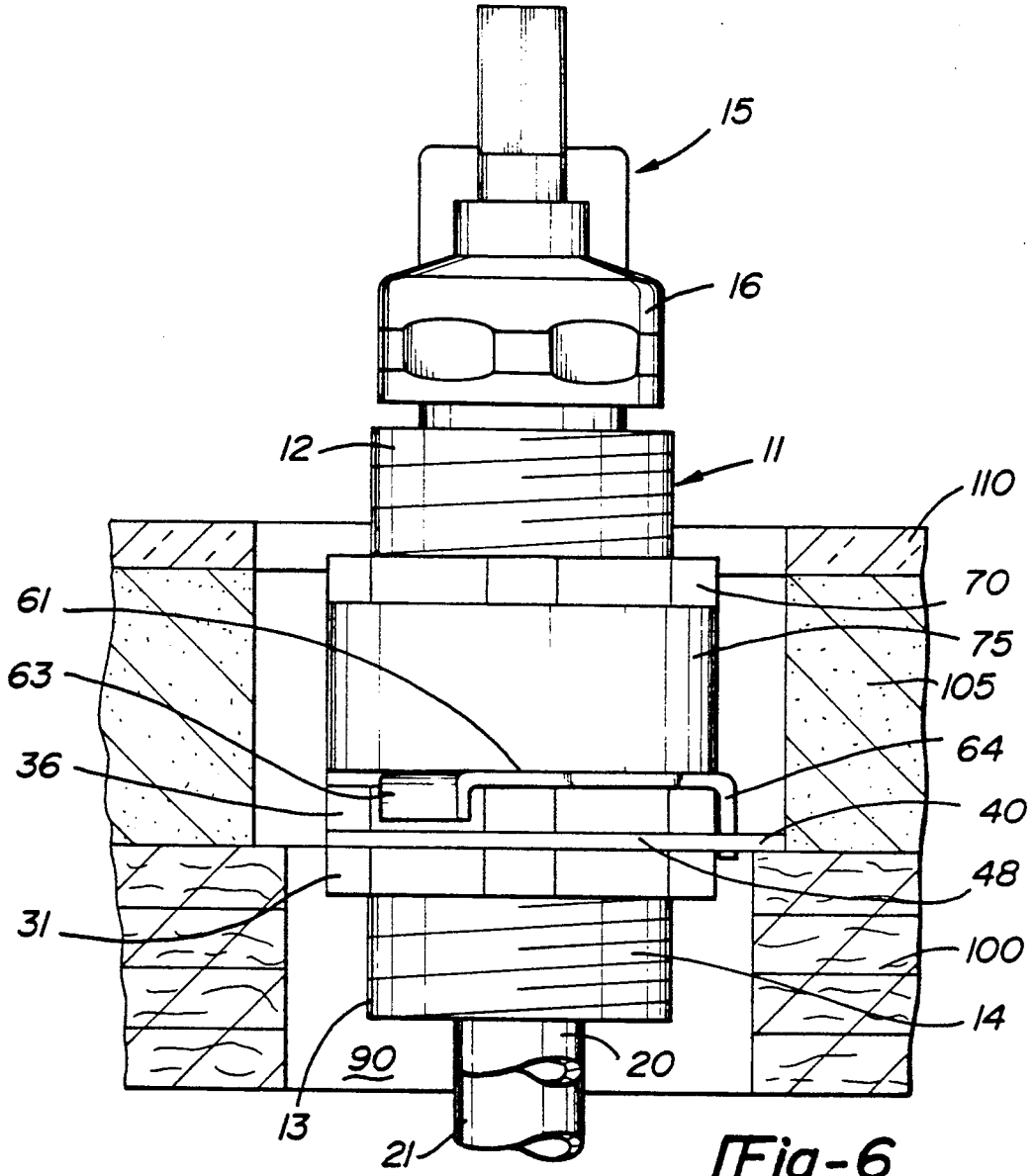
FIG. 6 is a side elevational view, partly in section, of the assembly of FIG. 5 completely assembled and mounted within a deck of a conventional type Roman tub.
Figure 7:
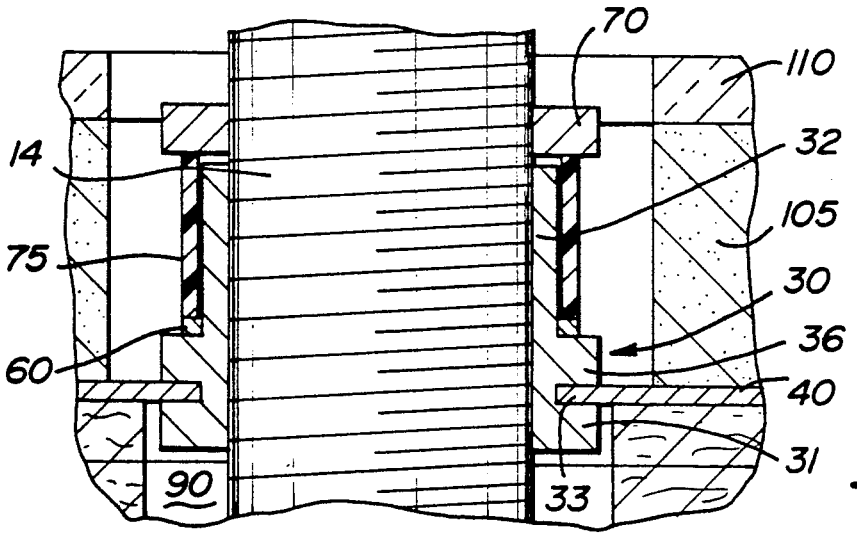
FIG. 7 is a side elevational view in section showing a portion of the assembly of FIG. 5 completely assembled and mounted within a deck of a conventional type Roman tub.

In the embodiment illustrated in FIGS. 5–7 the adapter 30 is mounted over receiver body 11 in an inverse position relative to that illustrated in FIGS. 1–4. In this embodiment the flanges 31 and 36 and slot 33 are at the bottom of adapter 30 rather than at the top as in the embodiment illustrated in FIGS. 1–4.

In this embodiment instead of jam nut 70 being screwed down on retainer 60, bushing 70 is slid down over tubular wall 32 of adapter 30 to abut against retainer 60, and jam nut 70 is then screwed down on bushing 75. That is to say, bushing 70 is interposed between retainer 60 and jam nut 70. Bushing 70 has a cylindrical shape with a hollow interior having an inner diameter greater than the center of diameter of tubular wall 32 of adapter 30.

It should be noted that in the embodiment illustrated in FIGS. 1–4 the retainer 60 rests on top flange 31 of adapter 30. In the embodiment illustrated in FIGS. 5–7 the retainer 60 rests on top of flange 36 of adapter 30.

The embodiment illustrated in FIGS. 5–7 allows for greater vertical adjustment of receiver body than the embodiment illustrated in FIGS. 1–4, e.g., from about $\frac{7}{8}$ inch to about $2\frac{3}{4}$ inches versus from about $\frac{1}{4}$ inch to about $1\frac{1}{2}$ inches for the embodiment illustrated in FIGS. 1–4.

Other modifications can be made to those which have been described in the text and illustrated in the figures by way of example without departing from the scope of the instant invention.

What is claimed is:

1. A valve fitting assembly containing a handle assembly mounted thereon for flush mounting said handle assembly to walls or decks comprised of rough wall and finished wall of variable thicknesses comprising:

an externally threaded receiver body having a bottom portion, a top portion, and a passageway extending axially therethrough in communication with said bottom portion and said top portion, said bottom portion adapted to receive water inlet and water outlet pipes, said top portion having valve means in communication through said passageway with said water inlet and water outlet pipes;

means for mounting said receiver body to the rough wall, the mounting means providing for adjustment of the axial position of the receiver body relative to the finished wall, said mounting means comprising an adapter comprised of an internally threaded tubular member with its outer wall surface being unthreaded threadably rotatably mounted over said receiver body and secured against axial movement relative to said rough wall by securement means having a first end and a second end, said securement means engaging the adapter at said first end and secured to the rough wall at said second end, whereby rotation of said adapter causes axial movement of said receiver body in said adapter.

2. The assembly according to claim 1 wherein two radially extending axially spaced apart flanges are disposed on said adapter, said flanges and said outer wall surface of said tubular member defining a radially extending sot.

3. The assembly according to claim 2 wherein said flanges have a generally polygonal cross-sectional configuration.

4. The assembly according to claim 3 wherein said flanges have a generally hexagonal cross-sectional configuration.

5. The assembly according to claim 3 wherein said securement means comprises a flat flange secured to the rough wall at said second end and engaging said slot in said adapted at said first end.

6. The assembly according to claim 5 which further includes means for securing said adapter against rotation.

7. The assembly according to claim 6 wherein said means for securing said adapter against rotation comprise a retainer comprised of an annular member having at least three downwardly depending legs, two of said legs adapted to engage the sides of at least one of said radially extending flanges in said adapter, and said third leg adapted to engage a recess in said flat flange.

8. A valve fitting assembly containing a handle mounted thereon for substantially flush mounting said handle to a wall or deck comprised of rough wall and finished wall of variable thicknesses comprising:

an externally threaded receiver body having a bottom portion, a top portion, and an internal passageway extending axially therein in communication with said bottom portion and said top portion, said bottom portion adapted to receive water inlet and water outlet pipes, said top portion containing valve means in communication with said water inlet and water outlet pipes through said passageway;

mounting means for mounting said receiver body to the rough wall, said mounting means providing for axial adjustment of the receiver body relative to the finished wall, said mounting means comprising an adapter comprised of an internally threaded threaded tubular member threadably rotatably mounted over said receiver body and secured against axial movement relative to said rough wall by securement means having a first end and a second end, said securement means engaging said adapter at said first end and secured to the rough wall at said second end, whereby rotation of said adapter causes axial movement of said receiver body in said adapter, said adapter further comprising two radially extending axially spaced apart flanges, said flanges and the outer surface of said adapter defining a radially extending slot.

9. The assembly according to claim 8 wherein said flanges have a generally polygonal cross-sectional configuration.

10. The assembly according to claim 9 wherein said flanges have a generally hexagonal cross-sectional configuration.

11. The assembly according to claim 8 wherein said securement means comprises a flat flange secured to the rough wall at said second end and engaging said slot in said adapter at said first end.

12. The assembly according to claim 11 which further includes means for securing said adapter against rotation.

13. The assembly according to claim 12 wherein said means for securing said adapter against rotation comprise a retainer comprised of an annular member having at least three downwardly depending legs, two of said legs adapted to engage the sides of at least one of said radially extending flanges in said adapter, sand said third leg adapted to engage a recess in said flat flange.

* * * * *